United States Patent [19]

Hirasawa et al.

[11] Patent Number: 4,926,219

[45] Date of Patent: May 15, 1990

[54] IMPROVED PAPER HANDLING MECHANISM IN CONJUNCTION WITH IMAGE FORMING APPARATUS SUCH AS LASER PRINTERS

[75] Inventors: Junichi Hirasawa, Yokohama; Yuichi Sato, Sendai; Toru Iida, Tokyo, all of Japan

[73] Assignee: Ricoh Company, Ltd., Tokyo, Japan

[21] Appl. No.: 251,394

[22] Filed: Sep. 30, 1988

[30] Foreign Application Priority Data

Sep. 30, 1987 [JP] Japan ..... 62-243899
Dec. 10, 1987 [JP] Japan ..... 62-311059
May 16, 1988 [JP] Japan ..... 63-116812

[51] Int. Cl.[5] ..... G03G 15/00
[52] U.S. Cl. ..... 355/309; 355/200
[58] Field of Search ..... 355/200, 210, 271, 273, 355/308, 309

[56] References Cited

U.S. PATENT DOCUMENTS 4,386,838 6/1983 Hirabayashi et al. ..... 355/200
4,464,042 8/1984 Omori et al. ..... 355/309
4,478,506 10/1984 Miyoshi et al. ..... 355/271
4,685,792 8/1987 Iseki et al. ..... 355/309
4,809,033 2/1989 Ikemoto et al. ..... 355/271

*Primary Examiner*—R. L. Moses
*Attorney, Agent, or Firm*—Oblon, Spivak, McClelland, Maier & Neustadt

[57] ABSTRACT

An image forming apparatus having an image forming case which is removably mounted on a body of the apparatus and loaded with a photoconductive drum, developing unit and a cleaning unit integrally therewith. A transfer charger unit and a register roller unit are each removably mounted on the image forming case by a holder. The holders of the transfer charger unit and register roller unit are individually accurately positioned relative to the case by a positioning mechanism when mounted on the case. The transfer charger unit is surely grounded when mounted on the case. An upper and a lower guide plate are interposed between the register roller unit and the photoconductive element for guiding a paper sheet. Opposite edges of each guide plate are individually disposed at predetermined positions.

31 Claims, 16 Drawing Sheets

IMPROVED PAPER HANDLING MECHANISM IN CONJUNCTION WITH IMAGE FORMING APPARATUS SUCH AS LASER PRINTERS

BACKGROUND OF THE INVENTION

The present invention relates to an image forming apparatus such as an electrophotographic copier, laser printer or similar non-impact printer, or facsimile apparatus. More particularly, the present invention relates to an image forming apparatus of the type including an image forming case or drawer removably mounted on the body of the apparatus and in which a photoconductive element, developing unit and cleaning unit are arranged integrally and replaceably, a transfer charger unit and a register roller unit removably mounted on the apparatus body and accurately positioned relative to the photoconductive element, and a guide arrangement for guiding a paper sheet which is transported via the register roller unit to between the photoconductive element and the transfer charger unit while maintaining the paper in a predetermined position relative to the photoconductive element, transfer charger unit and register roller unit.

An electrophotographic copier, printer, facsimile apparatus and other electrophotographic image forming apparatuses are implemented by substantially identical image forming units, i.e. photoconductive element unit, developing unit, cleaning unit, charger unit, etc. These units are individually replaced from time to time for replacement or repair. A current trend in the art of image forming apparatuses, especially printers and electrophotographic copiers, is toward user-oriented maintenance. In parallel with such a trend, that each of the image forming units be replaceable with ease by a user is becoming a prerequisite. To meet this requirement, there has been proposed a process kit in which a developing unit, cleaning unit and other image forming units which need periodic replacement are assembled integrally with each other. The process kit is bodily replaced when any of the image forming units is to be replaced upon the lapse of a certain period of time. Such a process kit scheme, however, increases the parts cost and therefore the running cost considering the fact that the service life and fatigue of each image forming unit depends upon its characteristics and the condition of use. Specifically, it may occur that when a certain image forming unit reaches the end of its life and needs replacement, the others still withstand further operations. Replacing the entire process kit in conformity to an image forming unit which should be replaced first, i.e., discarding image forming units which are still usable increases the parts cost and therefore the running cost, casting an excessive burden on a user.

To eliminate such a drawback particular to a process kit, there has also been proposed a system in which a cleaning unit, developing unit, photoconductive element and other image forming units are each provided with a different replacement cycle and replaced independently of each other. For the replacement, two different approaches are available: mounting the image forming units on the apparatus body such that they may be pulled out independently of each other at the time of replacement, and mounting the image forming units on a single image forming case and removably mounting the case on the apparatus body so that any of the units may be replaced by drawing out the entire case.

The first-mentioned approach suffers from a drawback that each of the image forming units has to be equipped with an exclusive mechanism for pulling it out. Moreover, the image forming units have to be positioned with accuracy relative to each other and, since they are packed in a limited space, replacing the individual image forming units is troublesome. In addition, when a certain image forming unit is removed for replacement, it is apt to scratch or otherwise damage the others and/or toner is apt to drop to contaminate the interior of the apparatus. The second-mentioned approach is successful in positioning the individual image forming units with accuracy. Nevertheless, the replacement of each image forming unit with the second-mentioned approach is not easy and liable to cause dropping of toner and damage to the other image forming units.

It has been customary to mount the transfer charger unit and register roller unit on the apparatus body to facilitate the removal of a jamming sheet. Difficulty has therefore been experienced in maintaining an accurate positional relationship between the various image forming units mounted on the image forming case and the transfer charger and register roller unit, especially between the photoconductive element and a charge wire of the transfer charger unit. At least, an image forming apparatus having a body on which the transfer charger unit and register roller unit are removably mounted in addition to the image forming case has not been proposed. When, among others, the transfer charger unit is removably mounted on the apparatus body, it is extremely difficult to surely ground the casing of the unit.

An image forming apparatus of the type described includes a guide arrangement for guiding a paper sheet being transported via a register roller unit to between a photoconductive element and a transfer charger. The guide arrangement is usually implemented by an upper and a lower guide plate. These guide plates have to be adequately positioned relative to the photoconductive element and register roller unit. Otherwise, accurate transfer of a toner image would fail due to deviation or local omission of an image which is ascribable to the deflection of the paper sheet or the reaction force of the trailing edge of the paper sheet. To insure accurate transfer, therefore, it is necessary to constantly maintain the above-stated positional relationship accurate. However, a practical solution has not been reported concerning the most desirable positional relationship.

SUMMARY OF THE INVENTION

It is therefore an object of the present invention to provide an image forming apparatus which promotes easy maintenance by a user by dematchably mounting on a body of the apparatus an image forming case loaded with a photoconductive element, developing unit and a cleaning unit integrally and replaceably, a transfer charger unit, and a register roller unit.

It is another object of the present invention to provide an image forming apparatus which maintains in an optimal positional relationship a photoconductive element mounted on an image forming casing, which is removable from a body of the apparatus, and a transfer charger unit and a register roller unit which are removable from the apparatus body.

It is another object of the present invention to provide an image forming apparatus which, when any of image forming units mounted on an image forming case which is removable from a body of the apparatus is to be replaced, prevents the unit from scratching or otherwise damaging the nearby units.

It is another object of the present invention to provide an image forming apparatus which facilitates maintenance, inspection and replacement of various image forming units and parts.

It is another object of the present invention to provide an image forming apparatus which prevents toner from dropping from image forming units which are mounted on an image forming case which is removable from a body of the apparatus.

It is another object of the present invention to provide an image forming apparatus which surely grounds a transfer charger unit which is removably mounted on a body of the apparatus.

It is another object of the present invention to provide an image forming apparatus which maintains an upper and a lower guide plate adapted to guide a paper sheet to between a photoconductive element and a transfer charger unit in an adequate positional relationship to a photoconductive element and a register roller unit, thereby eliminating the deviation of an image on the paper sheet.

It is another object of the present invention to provide a generally improved image forming apparatus.

In accordance with the present invention, in a electrophotographic image forming apparatus including a developing unit for developing a latent image which is provided on a photoconductive element into a visible image, a transfer charger unit for transferring the visible image onto a paper sheet which is fed from a register roller unit, and a cleaning unit for cleaning the photoconductive element, image forming unit holding means is removably mounted on a body of the apparatus and loaded with the photoconductive element, developing unit and cleaning unit which are replaceable individually integrally with the unit holding means. Transfer charger holding means is detachably mounted on the image forming unit holding means and loaded with the transfer charger unit replaceably. Register roller unit holding means is removably mounted on the image forming unit holding means and loaded with the register roller unit replaceably. Transfer charger unit positioning means positions the transfer charger unit holding means relative to the body of the apparatus and image forming unit holding means. Register roller unit positioning means positions the register unit holding means relative to the body of the apparatus and image forming unit holding means.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
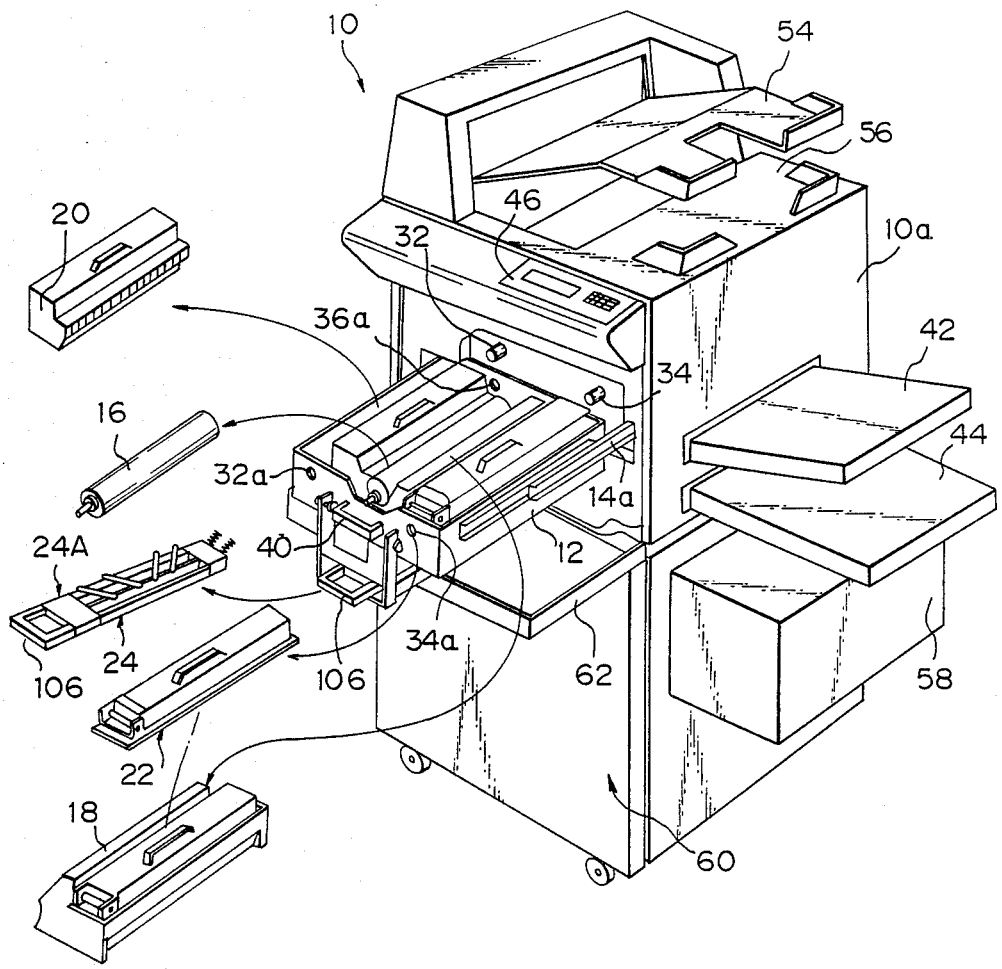
FIG. 1 is a perspective view showing a laser printer representative of a family of image forming apparatuses and embodying the present invention.
Figure 2:
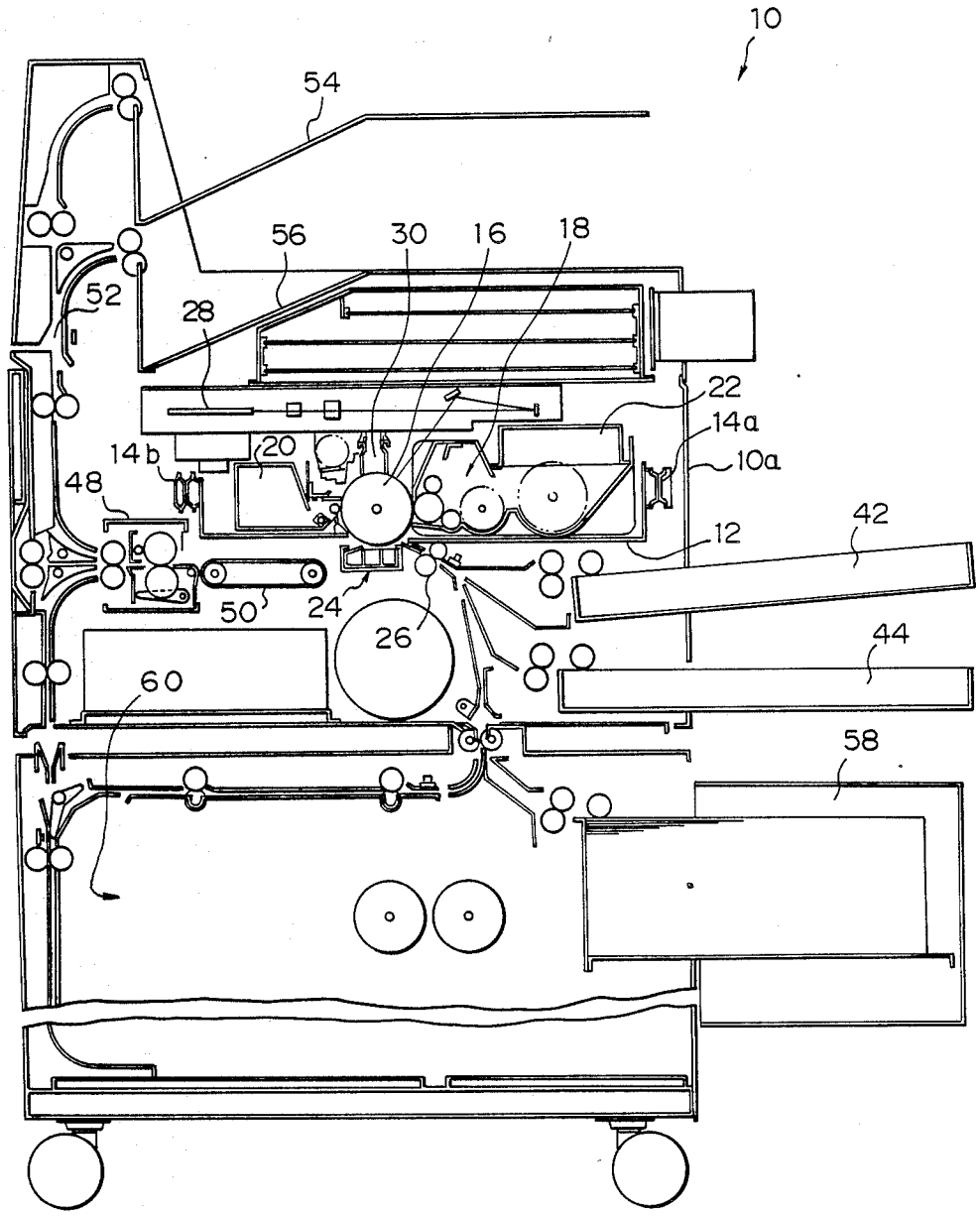
FIG. 2 is a sectional side elevation of the printer shown in FIG. 1.

Referring to FIG. 1 of the drawings, an image forming apparatus embodying the present invention is shown and implemented as a laser printer by way of example. In the figure, an image forming case or drawer on which image forming units such as a photoconductive element, developing unit, cleaning unit and transfer charger unit are removably mounted is shown in a position drawn out from the body of the printer. FIG. 2 shows the printer in a section.

As shown in FIGS. 1 and 2, the laser printer, generally 10, includes a body **10*a* and an image forming case or drawer 12. The case 12 is slidably mounted on one side of the printer body 10*a* by guide rails 14*a* and 14*b*. Image forming units such as a photoconductive element 16, developing unit 18, cleaning unit 20 and toner cartridge 22 are individually removably mounted on the case 12. A transfer charger unit 24 is removably mounted in a lower portion of the case 12. A register roller unit 26, FIG. 2, is also removably mounted on the case 12 as will be described in detail later. When the case 12 is loaded in the printer body 10*a*, the individual image forming units are adequately positioned relative to each other so that an electrophotographic recording cycle may be performed accurately. Such image forming units are also positioned with accuracy relative to an optical writing unit 28, charger 30, register roller unit 26 and other units which are supported by the printer body 10*a*. Specifically, pins 32 and 34 are studded on the front panel of the printer body 10*a* while pins 36 and 38 are studded on the rear panel (not visible). The pins 32** and 34 and the pins 36 and 38 are respectively received in holes 32*a* and 34*a* and holes 36*a*and 38*a* (not visible) which are respectively formed through the front and rear walls of the case 12, whereby the case 12 is positioned relative to the printer body 10*a*.

When the case 12 is drawn out of the printer body 10*a*, the developing unit 18 and toner cartridge 22 are automatically moved away from the photoconductive element 16, i.e. to the right as viewed in FIG. 2. At the same time, the cleaning unit 20 is automatically moved away from the element 16 to the left as viewed in FIG. 2. As a result, extra spaces are defined between the nearby units. Such extra spaces allow any of the units to be replaced with ease and without damaging the others.

A handle 40 is provided on the front end of the case 12 to facilitate the draw of the case 12. Such a handle is also provided on each of the developing unit 18, cleaning unit 20 and toner cartridge 22 although not shown in FIG. 2. Mechanisms for mounting and dismounting the transfer charger unit 24 and register roller unit 26 will be described in detail later.

The printer body 10*a* is further loaded with a first sheet cassette 42 and a second sheet cassette 44 each storing a stack of paper sheets, a display section 46, a fixing unit 48 for fixing a toner image provided by the various image forming units by applying heat and pressure to the toner image, and a transport unit 50. A first tray 54 and a second tray 56 are located in an upper portion of the printer body 10*a*for receiving printed paper sheets which are discharged from the printer body 10*a* by way of a transport path 52. The printer body 10*a* is operable with a mass sheet feed unit 58 and an reversal unit 60 which are available as optional units. The reversal unit 60 turns over a paper sheet which carries an image on one surface thereof and comes out of the fixing unit 48 and then feeds such a paper sheet face down toward the image forming units. After the case 12 has been received in the printer body 10*a*, a cover 62 mounted on the printer body 10*a* is closed to eliminate the entry of dust and other impurities into the printer 10 while insuring attractive appearance.

Figure 3:
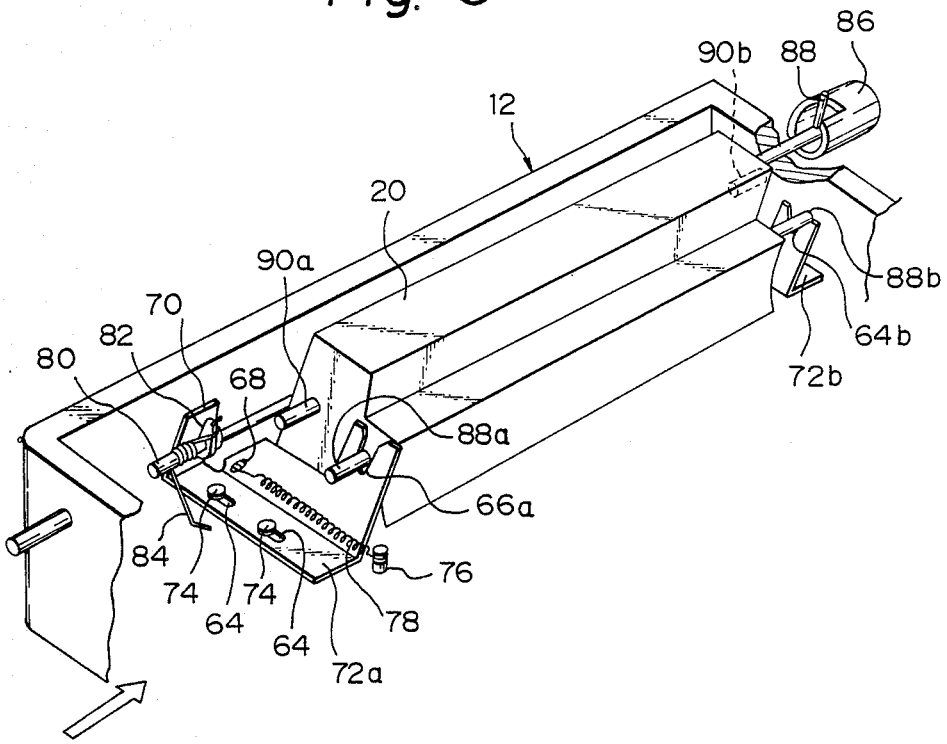
FIGS. 3 and 4 show a specific mechanism for allowing a cleaning unit of the embodiment to move away from a photoconductive element when an image forming case is drawn out.
Figure 4:
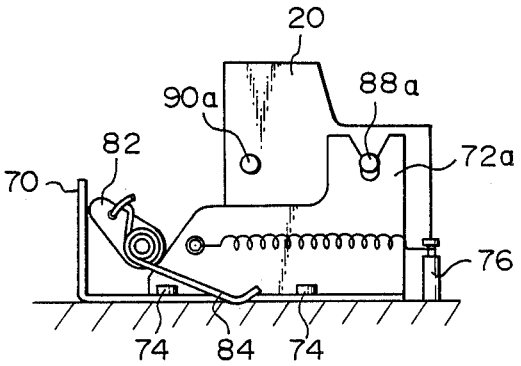

Referring to FIGS. 3 and 4, a specific construction for spacing the cleaning unit 20 from the photoconductive element 16 when the case 12 is drawn out is shown. As shown, a pair of sliders 72*a* and 72*b* are individually provided with slots 64, notches 66*a* and 66*b*, lugs 68, and abutments 70. The sliders 72*a* and 72*b* are individually located at the front and the rear of the case 12 with respect to the direction of draw. Guide pins 74 are individually received in the slots 64 so that the sliders 72*a* and 72*b* are slidable relative to the case 12. A spring 78 is anchored at one end to the lug 68 of the slider 72*a* and at the other end to a pin 76 which is studded on the bottom of the case 12. A rod 80 extends between and throughout the front and rear walls of the case 12 while a cam 82 is rigidly mounted in that part of the rod 80 which aligns with the abutment 70 of the slider 72*a*. The rod 80 is constantly biased by a spring 84 to tend to rotate about its axis. It is to be noted that the other slider 72*b* is also provided with such a cam 82 and spring 84 although not shown in FIG. 3. A pin 88 is studded in a rear end portion of the rod 80 to be engageable with a cam 86 which is securely fitted on the printer body 10*a*.

Figure 5:
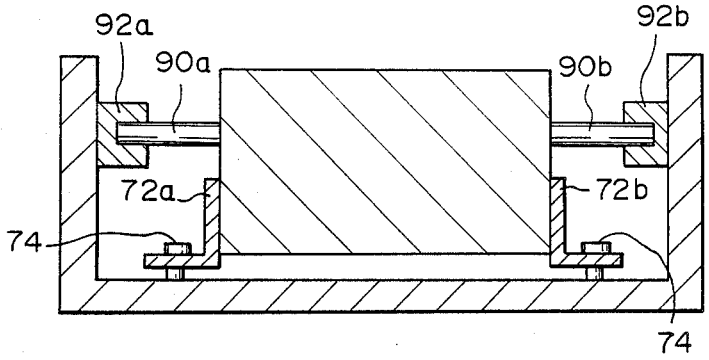
FIG. 5 is a schematic section showing a specific construction of a mechanism for supporting the cleaning unit on the image forming case in accordance with the present invention.
Figure 6:
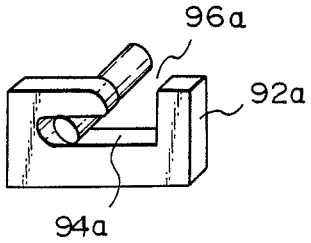
FIG. 6 is a perspective view schematically showing a portion for supporting a pin which is included in the mechanism of FIG. 5.

The cleaning unit 20 is provided with two pins at the front end and other two pins at the rear end. Two 88*a* and 88*b* of those pins are respectively received in the notches 66*a* and 66*b* of the sliders 72*a* and 72*b*, as shown in FIG. 4 (only one side is shown). As shown in FIG. 5, the other two pins 90*a* and 90*b* are respectively held by support portions 92*a* and 92*b* which are provided on the side walls of the printer body 10*a*. As shown in FIG. 6, the support portions 92*a* and 92*b* include respectively elongate slots 94*a* and 94*b* and notches 96*a* and 96*b* which are disposed above and contiguous with the slots 94*a* and 94*b*, respectively. The pins 90*a* and 90*b* are respectively introduced into the slots 94*a* and 94*b* through the notchs 96*a* and 96*b* and then slid along the slots 94*a* and 94*b*.

When the image forming case 12 is held in an operative position within the printer body 10*a*, the pin 88 studded on the rod 80 abuts against a rear part of the cam profile of the cam 86 while, at the same time, the springs 84 prevent the pin 88 from rotating the cam 82. In this condition, only the resilience of the springs 78 effectively act on the sliders 72*a* and 72*b* so that the cleaning unit 20 supported by the sliders 72*a* and 72*b* is brought to its predetermined operatative position adjacent to the photoconductive element 16. More specifically, the cleaning unit 16 is pulled by the springs 78 to the right as viewed in FIG. 3 to reach a reference position. When the case 12 is drawn out of the printer body 10*a*, the pin 88 on the rod 80 is released from the cam 86 and, hence, the cams 82 are urged by the springs 84 to press their associated abutments 70. Since the force of the springs 84 are selected to be greater than the force of the springs 78, the sliders 72*a* and 72*b* are shifted to the right in the figure to in turn pull the pins 88*a* and 88*b* of the cleaning unit 20. As a result, the cleaning unit 20 is bodily moved away from the photoconductive element 16.

The mechanism described above in relation to the cleaning unit 20 may also be applied to the developing unit 18. Then, the developing unit 18 will be shifted away from the photoconductive element 16 when the case 12 is drawn out of the printer body 10*a*.

In the illustrative embodiment, in order that the image forming units mounted on the case 12 may be automatically spaced from each other upon the draw of the case 12 from the printer body 10*a*, the detection of the position of the case 12 and the sliding motion of any of the units which occurs on the basis of the detected position of the case 12 are implemented by the combination of a plurality of cam mechanisms. If desired, such cam mechanisms may be replaced with electrical sensing means responsive to the position of the case 12 and an electromagnetic mechanism which is driven by an output of the sensing means.

Figure 7:
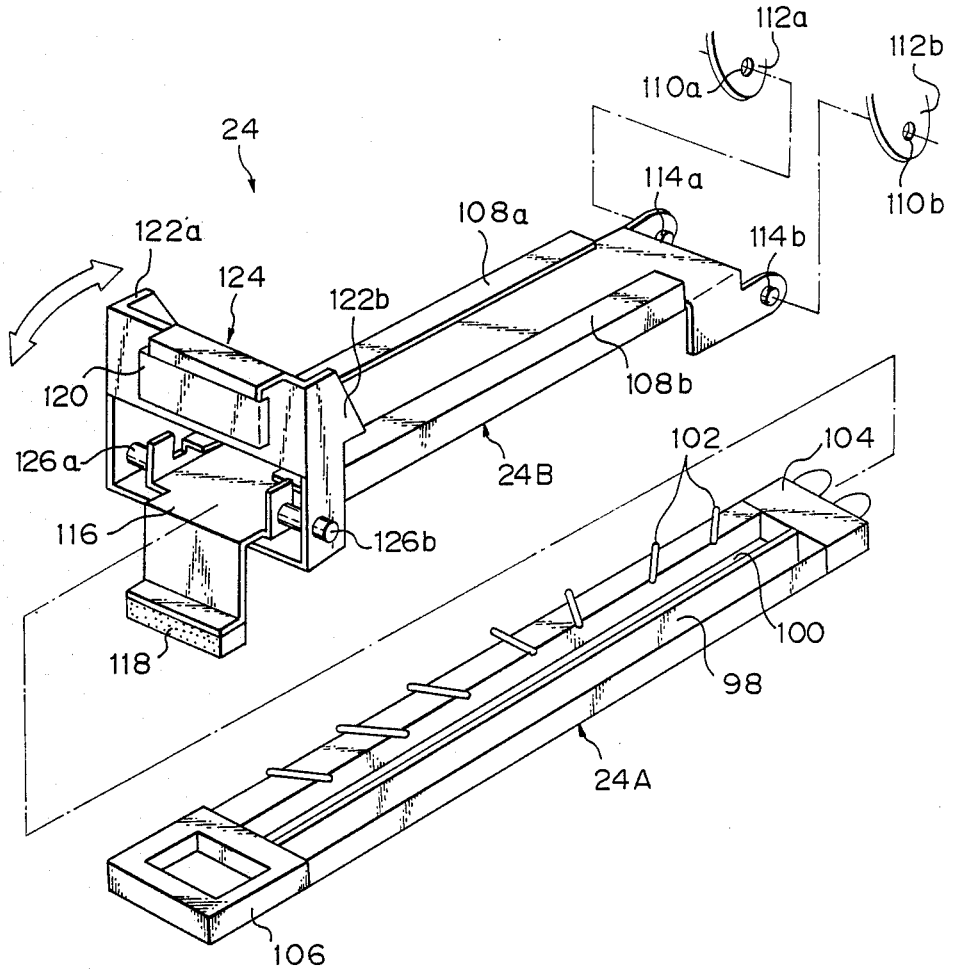
FIG. 7 is a perspective view showing a specific construction of a mechanism for mounting a transfer charger unit on the image forming case in accordance with the present invention.
Figure 13:
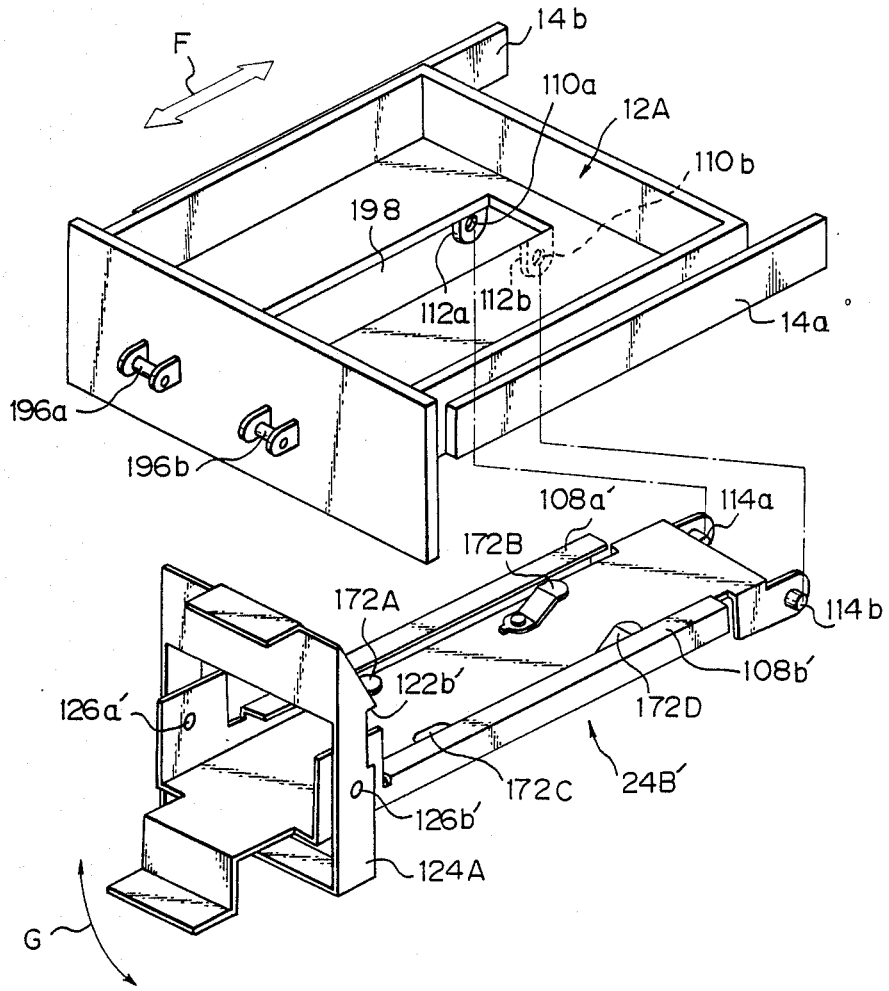
FIG. 13 is a perspective view showing a specific construction of a transfer charger unit in accordance with the present invention.

Referring to FIG. 7, a mechanism for mounting the transfer charger unit 24 on the case 12 is shown. The transfer charger unit 24 is made up of a charger 24A and a charger holder 24B. The charger 24A includes a transfer charger section 98, a separation charger section 100, ribs 102 for promoting smooth sheet feed, a section for setting up electrical connection to the printer body 10*a*, and a handle 106. The charger 24A is removably supported by the charger holder 24B. Rails 108*a* and 108*b* are provided on opposite sides of the charger holder 24B so that the charger 24A may be slid into and out of the holder 24B from the front end of the latter. Projections 112*a* and 112*b* extend from a rear lower part of the case 12 which corresponds to the photoconductive element 16. The projections 112*a* and 112*b* are provided with holes 110*a* and 110*b*, respectively. Pins 114*a* and 114*b* are studded on the rear end of the charger holder 24B. When the pins 114*a* and 114*b* are mated with the holes 110*a* and 110*b*, respectively, the charger holder 24B is rotatable downward about the pins 114a and 114b. The front end 116 of the charger holder 24B is bent generally in the form of a letter L. An elastic member 118 made of rubber, soft resin or similar material is adhered to the bottom of "L" of the holder end 116. When the charger holder 24B is rotated downward, the elastic member 118 prevents the front end of the holder 24B from hitting against and damaging the outer surface of the printer body 10a. A lock lever 124 is provided with a handle 120 and engaging portions 122a and 122b and rotatably connected to the front end of the charger holder 24B by pins 126a and 126b. Pins 196a and 196b, FIG. 13, are studded on the front end of the case 12 to mate respectively with the engaging portions 122a and 122b of the lock lever 124, thereby supporting the charger holder 24B.

In the event of replacement of any of the image forming units or a sheet jam, the handle 40 of the case 12 is pulled away from the printer body 10a so that the case 12 is drawn out of the printer body 10a, as shown in FIG. 1. Simultaneously, the cleaning unit 20, developing unit 18 and other image forming units are automatically shifted away from the photoconductive element 16. The resulting extra spaces between the nearby units facilitate the replacement of any of the units and prevent the photoconductive element 16, a blade of the cleaning unit 20 and other susceptible units from being damaged. In addition, the unit to be replaced can be picked up with hardly any toner being dropped. Although toner may drop through a bottom opening of the case 12 where the photoconductive element 16 is located when the case 12 is pulled out, it is surely caught by the charger 24A which is drawn out together with the case 12.

Further, the charger 24A serves to receive toner which may drop from the cleaning unit 20 and/or the developing unit 18 while the case 12 is held in the operative position within the printer body 10a. This frees the interior of the printer body 10a from contamination due to such toner. To remove a jamming sheet, the case 12 is drawn out of the printer body 10a and then the handle 120 is pulled to release the lock lever 124. Then, the charger holder 24B and the charger 24A retained by the holder 24B are rotated downward about the pins 114a and 114b away from the photoconductive element 16, allowing the jamming sheet to be removed with ease. The charger 24B may be drawn out by pulling the handle 106 so as to replace the charger 24A or to collect toner which may be accumulated on the charger 24A.

Figure 8:
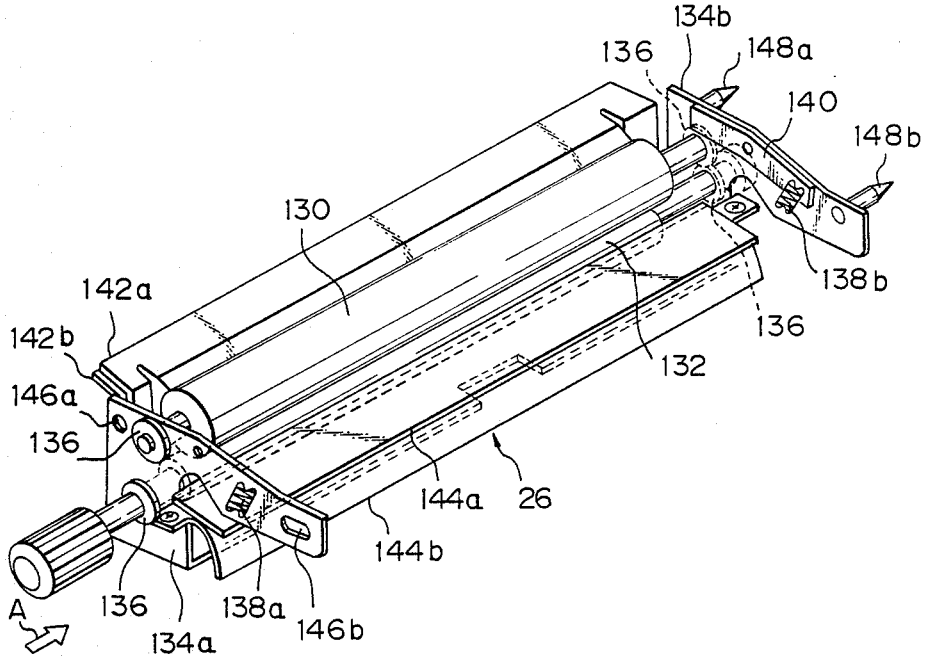
FIG. 8 is a perspective view showing a specific construction of a mechanism for mounting a register roller unit on the image forming case in accordance with the present invention.
Figure 9:
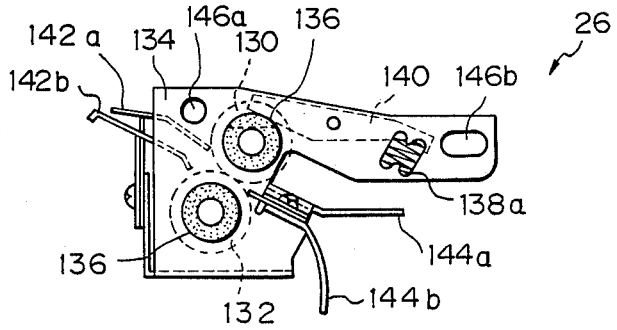
FIG. 9 is a side elevation of the mechanism shown in FIG. 8.
Figure 10:
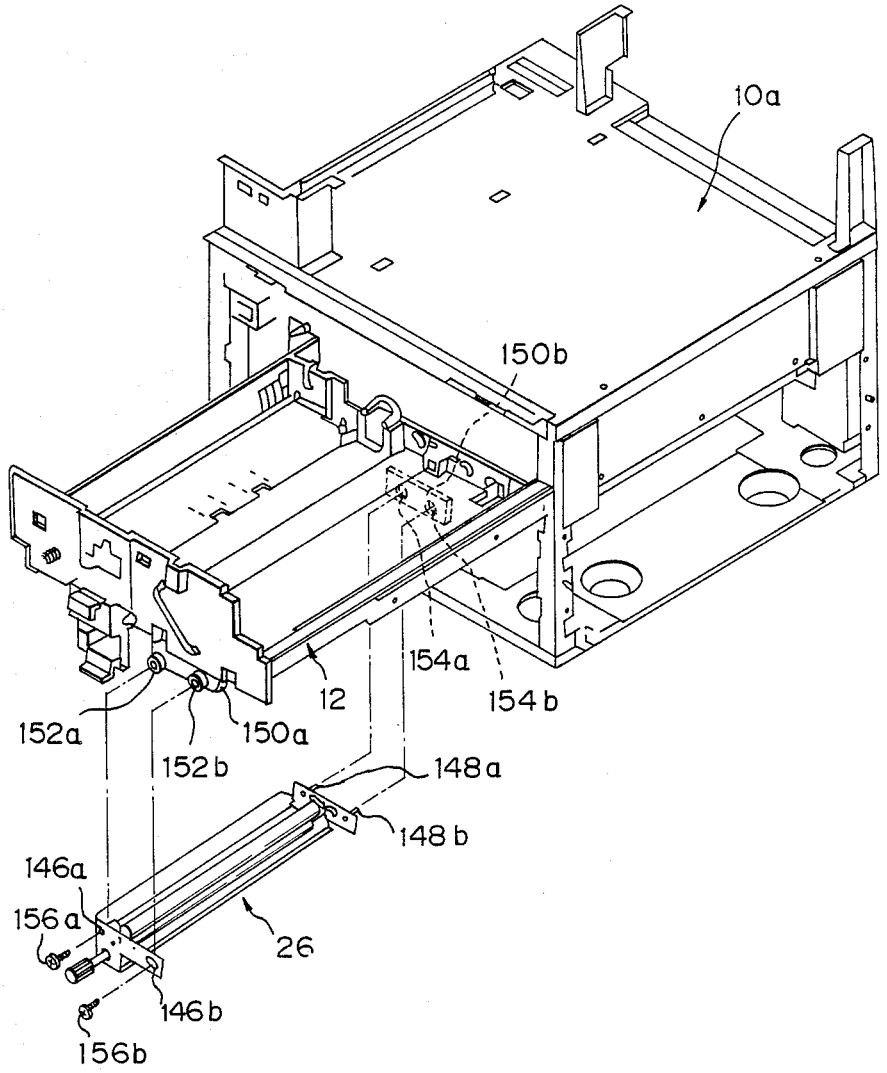
FIG. 10 is a perspective view of a specific construction of a mechanism for mounting the image forming case and register roller unit on the apparatus body.

FIG. 8 shows a mechanism for mounting the register roller unit 26 on the image forming case 12. FIG. 9 is a side elevation as viewed in a direction indicated by an arrow A in FIG. 8. As shown, the register roller unit 26 comprises a register roller 130 made of metal, a register roller 132 made of rubber, roller unit frame members 134a and 134b, four roller bearings 136, roller biasing springs 138a and 138b, roller biasing arms 140, an upper guide plate 142a and a lower guide plate 142b which constituted a pretransfer guide device in cooperation, and an upper guide plate 144a and a lower guide plate 144b constituting a preroller guide device. The front frame member 134a is provided with holes 146a and 146b for positioning the roller unit while the rear frame member 134b is provided with pins 148a and 148b for positioning the roller unit. As shown in FIG. 10, the front and rear walls of the case 12 are respectively provided with ribs 150a and 150b for positioning the case 12 and the rollers relative to each other. Positioning pins 152a and 152b are studded on the front rib 150a to mate with the holes 146a and 146b, respectively. The rear rib 150b is provided with holes 154a and 154b to mate with the pins 148a and 148b, respectively. After the pins 152a and 152b have been inserted into the holes 146a and 146b, respectively, the register roller unit 26 is fastened to the front rib 150a by screws 156a and 156b. At the same time, the pins 148a and 148b are inserted into the holes 154a and 154b, respectively. Hence, the register roller unit 26 is positioned at both of the front and rear ends. The pins 148a, 148b, 152a and 152b and the holes 146a, 146b, 154a and 154b are provided on their associated ribs and frame members such that the register roller unit 26 may be positioned relative to the charger unit 24 and photoconductive element 16.

Figure 11:
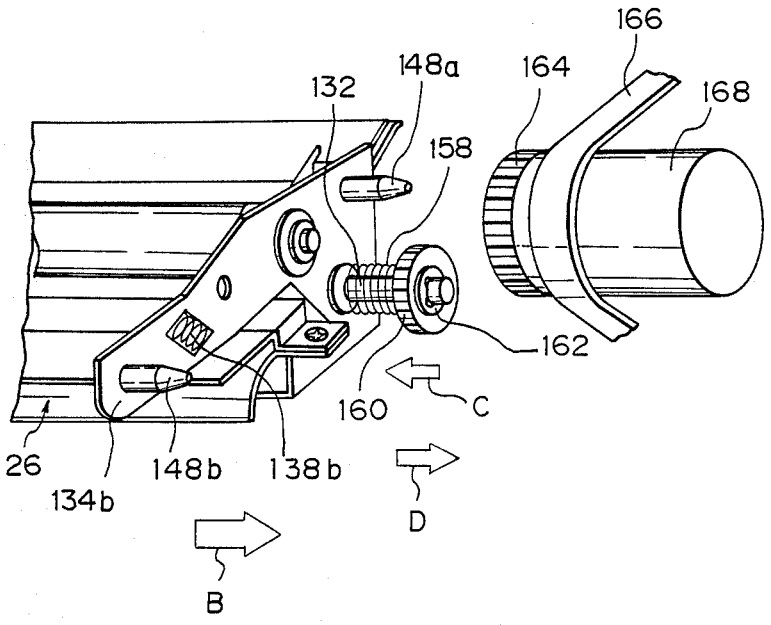
FIG. 11 is a perspective view of a specific construction of a drive mechanism associated with the register roller unit and the apparatus body.

Referring to FIG. 11, a mechanism for driving the register roller unit 26 is shown. In the figure, a drive gear 160 is urged against the end of a shaft of the rubber roller 132, FIGS. 8 and 9, by an E-ring 162 through a spring 158 and thereby fixed in place on that shaft. Also shown in the figure are a drive gear 164 mounted on the printer body 10a, a timing belt 166, and an electromagnetic clutch 168. The register roller unit 26 is removably fastened to the underside of the case 12 by the screws 156a and 156b, as shown in FIG. 10. Hence, when the case 12 is inserted into the printer body 10a, the register roller unit 26 is moved in a direction indicated by an arrow B in FIG. 11 until the drive gear 160 makes contact with the drive gear 164 of the printer body 10a. Consequently, the drive gear 160 is urged in a direction of arrow C. When the two gears 164 and 160 are brought into mesh with each other, the gear 160 is urged by the spring 158 as indicated by an arrow D into positive mesh with the gear 164. In this condition, a driving force may be transmitted from the printer body 10a to the rubber roller 132. A paper sheet fed from any of the sheet cassettes 42 and 44 is directed toward a nipping section of the roller 130 and rubber roller 132 by the guide plates 144a and 144b, FIG. 9. The paper sheet driven by the roller 130 and 132 is guided by the guide plates 142a and 142b toward the transfer charger unit 24 and photoconductive element 16 which are held in a predetermined relative position. As shown in FIG. 9, the metal roller 130 is pressed against the rubber roller 130 by the springs 138a and 138b through the frame members 134a and 134b and the arms 140 which are rotatably supported.

Hereinafter will be described an arrangement for grounding the transfer charger unit 24.

Figure 12:
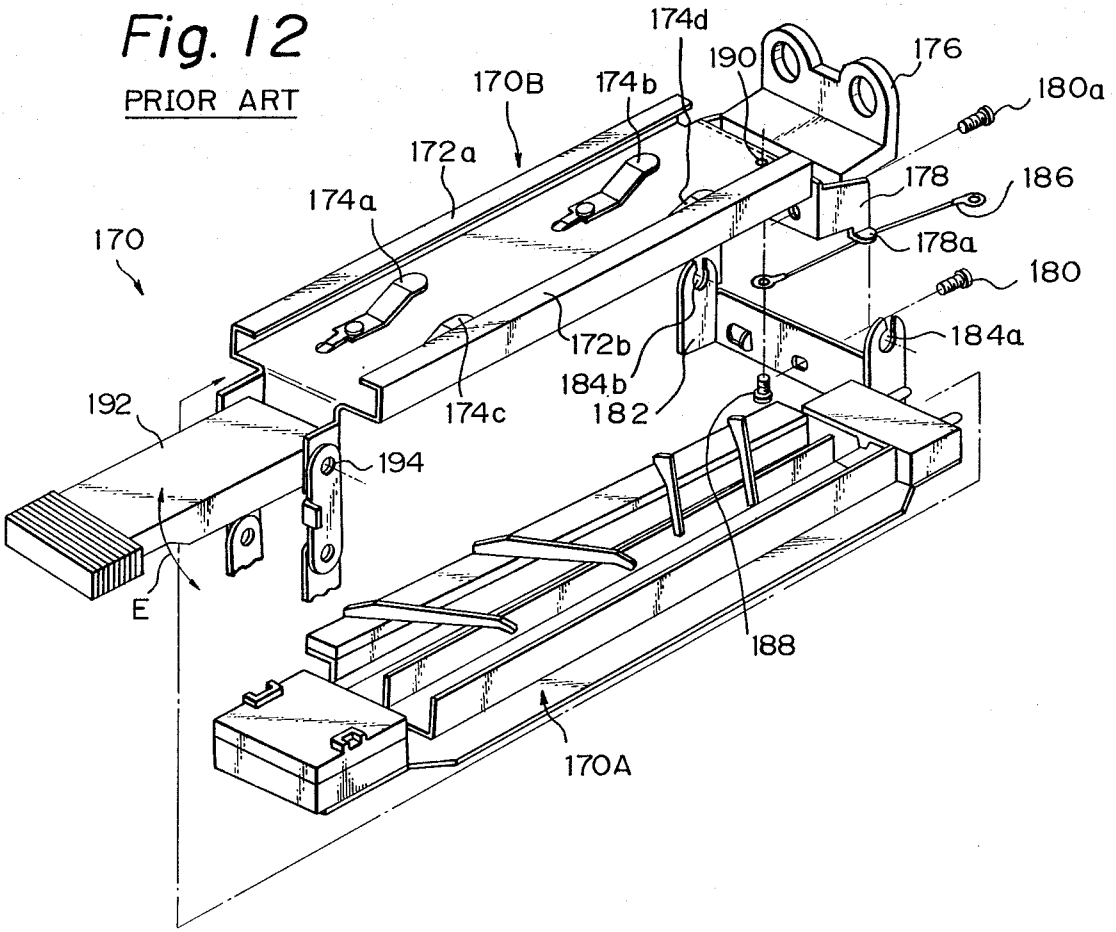
Fig. 12 PRIOR ART
FIG. 12 is an exploded perspective view of a prior art transfer charger unit.

Referring to FIG. 12, a prior art transfer charger unit is shown and generally designated by the reference numeral 170. The transfer charger 170 is shown as comprising a transfer charger 170A and a charger holder 170B. The transfer charger 170A is guided and urged by leaf springs 174a and 174b which are provided on rails 174a to 174d, whereby the charger 170A is slidably retained on the rails 174a to 174d. A receptacle 176 and a bearing plate 178 are fastened together by screws 180a and 180b. Tongues 178a and 178b formed by bending the plate 178 are respectively received in notches 184a and 184b of a bracket 182 which is fastened to the apparatus body by screws 180. Hence, the subassembly of the receptacle 176 and plate 178 are rotatable about the tongues 178a and 178b. A ground wire 186 is fastened at one end to a threaded hole 190 of the charger holder 170B by a screw 188 and at the other end to the framework of the apparatus body. A lever 192 is rotatable about a shaft 194 as indicated by an arrow E. In this manner, when the case 12 loaded with the various image forming units is inserted in the apparatus body, the charger holder 170B, i.e., casing of the transfer charger unit 170 is connected to ground by the ground wire 186 via the apparatus body.

A drawback with the above-described prior art grounding approach is that the transfer charge unit 170 cannot be grounded when it is drawn out of the apparatus body, unless the ground wire 186 has a subsantial length. A long ground wire 186 is apt to contact various parts which are mounted on the apparatus body and therefore impractical.

An alternative construction of the transfer charger unit 24 which is included in the image forming apparatus 10 of the present invention will be described with reference to FIGS. 13 and 14.

In FIG. 13, there is shown a charger holder 24B' of an alternative charger unit and an image forming case 12A on which the charger holder 24B' is rotatably mounted. The case 12A is movable along the guide rails **14*a* and 14*b* of the printer body 10*a* as indicated by an arrow F. An opening 198 is formed through an intermediate portion of the bottom of the case 12A for receiving the transfer charger 24A which is shown in FIG. 7. The rib holes 110*a* and 110*b* are adapted to receive the pins 114*a* and 114*b* of the charger holder 24B' so that the charger holder 24B' may be rotated about the pins 114*a* and 114*b*. The pins 196*a* and 196*b* are also provided on the case 12A. The charger holder 24B' includes a lever 124A which is formed with hook portions 122*a'* and 122*b'*. These hook portions 122*a'* and 122*b'* are respectively engaged with the pins 196*a* and 196*b* of the case 12A. The charger holder 24B' also includes the pins 114*a* and 114*b* which mate respectively with the rib holes 110*a* and 110*b*, rails 108*a'* and 108*b'* on which the transfer charger 24A is mounted, and leaf springs 172A to 172D pressed against the rails 108*a'* and 108*b'*, respectively. The lever 124A is free to rotate about pins 126*a'* and 126*b'* and usable to rotate the charger holder 24B' about the pins 114*a* and 114*b***.

Figure 14:
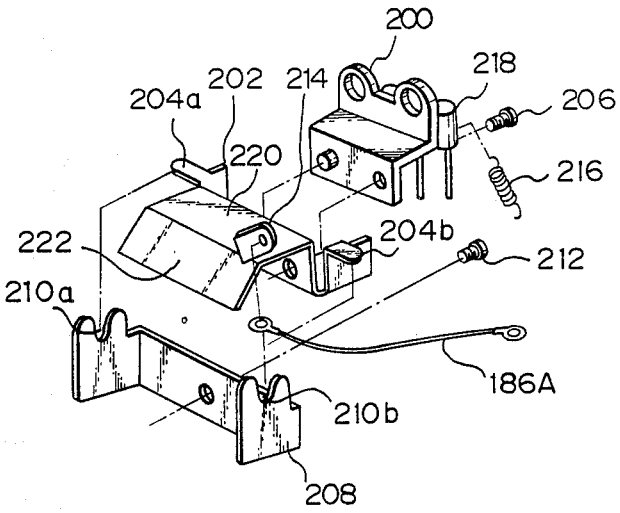
FIG. 14 is an exploded perspective view showing a mechanism for fitting a ground wire of the transfer charger unit shown in FIG. 13.

In FIG. 14, a bracket 202 has outwardly extending tongues **204*a* and 204*b* at opposite ends thereof and is fastened to a receptacle 200 by screws 206. The tongues 204*a* and 204*b* are respectively rotatably received in notches 210*a* and 210*b* of a bearing plate 208. The bearing plate 208 is fastened to the printer body 10*a* by a screw 212. A ground wire 186*a* is fastened at one end to a threaded hole 214 of the bracket 202 by a screw and at the other end to the printer body 10*a*. A spring 216 is anchored to a retaining portion 218 of the receptacle 200. The reference numerals 220 and 222** designate contacting portions.

Figure 15:
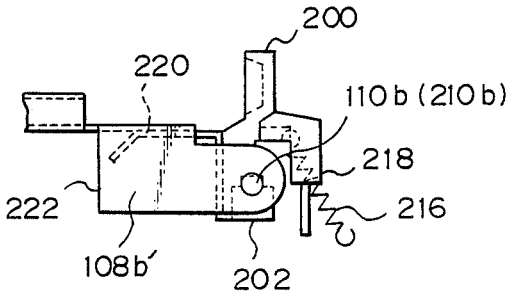
FIG. 15 is a side elevation showing how transfer charger rails and a bracket make contact.
Figure 16A:
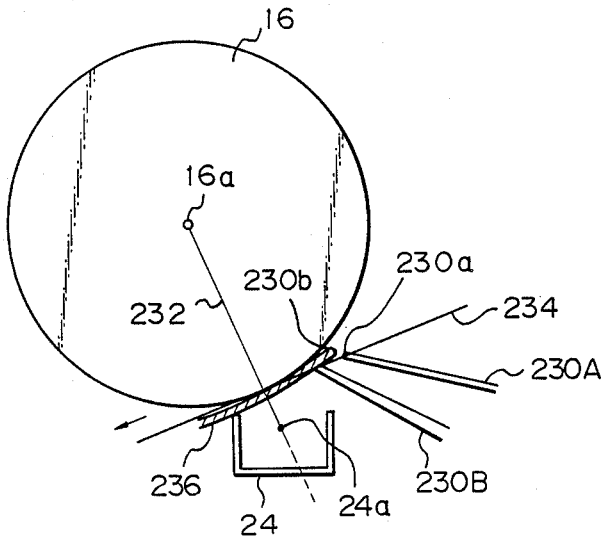
Fig. 16A PRIOR ART
FIGS. 16A, 16B, 17A, 17B and 18 schematically show the configuration of an upper and a lower guide plate which constitute a prior art guide arrangement.
Figure 16B:
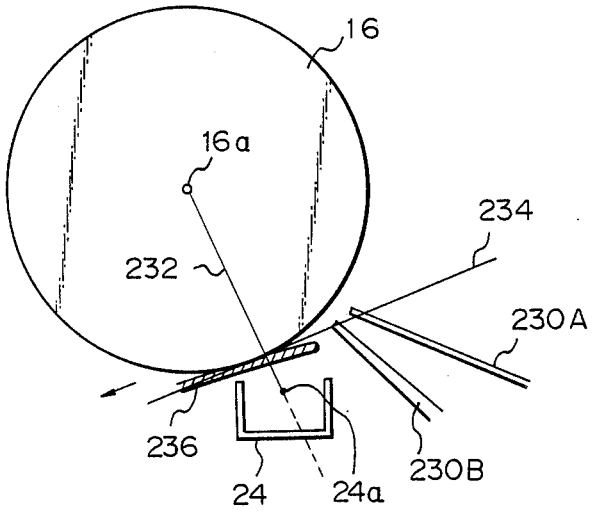
Fig. 16B PRIOR ART

In the arrangement shown in FIGS. 13 and 14, the charger holder 24B' is rotatable over a substantial angle about the pins **114*a* and 114*b* and the rib holes 110*a* and 110*b* of the case 12A, as indicated by an arrow G in FIG. 13. To mount the charger holder 24B' on the case 12A, the hook portions 122*a'* and 122*b'* of the lever 124A are individually engaged with the pins 196*a* and 196*b* of the case 12A. When the transfer charger 24A, FIG. 7, is pressed by the leaf springs 172A to 172D against the rails 108*a'* and 108*b'*, they are guided and securely mounted on the rails 108*a'* and 108*b'*. Here, it is necessary to ground the charger holder 24B' via the printer body 10*a*. As the case 12A is guided by the guide rails 14*a* and 14*b* and pushed into the printer body 10*a*, the contacting portion 220 of the bracket 202 is pressed against the bottom of the charger holder 24B', as shown in FIG. 15. Since the receptacle 200 is fastened to the bracket 202 by the screws 206 as previously stated and constantly pulled by the spring 216, the bracket 202 is rotated about the tongues 204*a* and 204*b* which are respectively received in the notchs 210*a* and 210*b* by the resulting angular moment. Consequently, the bracket 202 is brought into contact with the bottom of the charger holder 24B'. In this condition, the ground wire 186A connected to the bracket 202 and the printer body 10*a* as stated earlier grounds the charger holder or casing 24B' of the transfer charger 24A. More specifically, connecting the ground wire 186A to the charger holder 24B'** as has been practiced is not necessary.

When it is desired to rotate the charger holder 24B' about the pins **114*a* and 114*b* to remove a jamming sheet, for example, the bracket 202 has to be rotated because its contacting portions 220 and 222 are held in contact with the bottom of the charger holder 24B'. For the smooth rotation of the charger holder 24B', therefore, it is preferable that the center of the rib holes 110*a* and 110*b* of the bearing plate 208 be aligned with those of the notches 210*a* and 210*b* of the bearing plate 208**.

A guide arrangement is interposed between the photoconductive element 16 and the register roller unit 26 for guiding toward them a paper sheet which is fed from the sheet cassette 42, 44 or 58 and transported via the register roller unit 26, as previously stated. Such a guide arrangement will be discussed hereinafter.

Figure 17A:
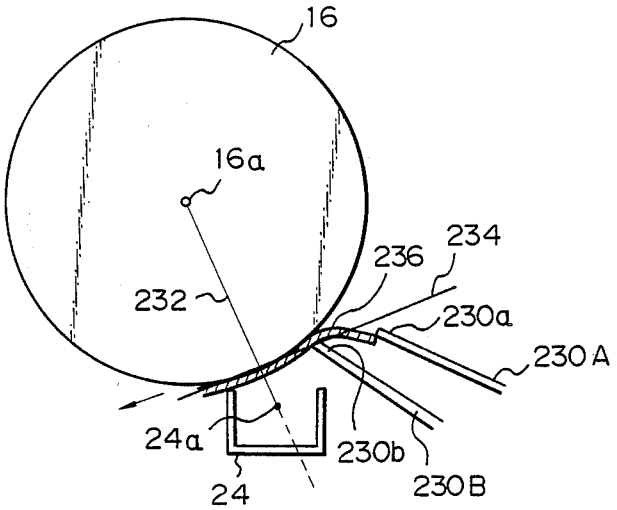
Fig. 17A PRIOR ART
Figure 17B:
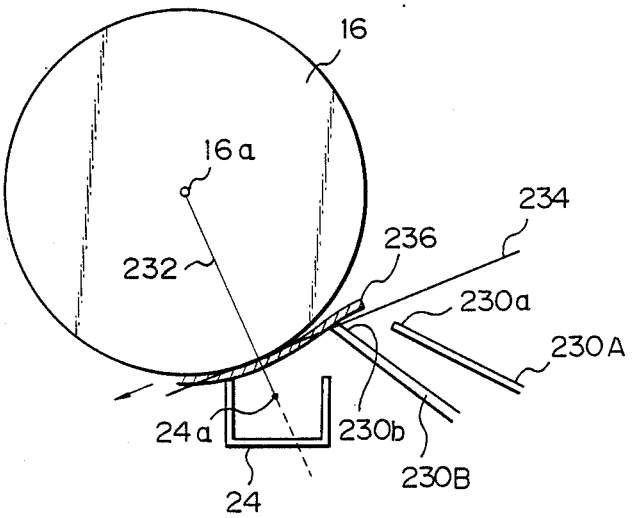
Fig. 17B PRIOR ART

First, a prior art guide arrangement will be described with reference to FIGS. 16A, 16B, 17A and 17B. As shown, a guide arrangement of the kind described is constituted by an upper guide plate 230 and a lower guide plate 230B. Heretofore, the relative position of the upper edges **230*a* and 230*b* of the upper and lower guide plates 230A and 230B, respectively, has not been regularized. Specifically, one of the edges 230*a* and 230*b* is positioned sometimes above the other and sometimes below the other with respect to a line 234 which is tangential to the photoconductive element 16 and intersects a line 232 which extends through the center 16*a* of the element 16 and a charge wire 24*a* of the transfer charger unit 24. The tangential line 234 may be regarded to substantially define a path along which a paper sheet 236 advances. Assuming that the edge 230*b* of the lower guide plate 230B is located above the tangential line 234, the paper 236 bends when it moves from the position shown in FIG. 16A (before it leaves the lower guide plate 230B) to the position shown in FIG. 16B. The paper 236 therefore tends to regain its original position as soon as it leaves the lower guide plate 230B, moving away from the photoconductive element 16. This often constitutes a cause of local omission of an image in a rear part of the paper 236. Conversely, assuming that the edge 230*a* of the upper guide plate 230A is located above the tangential line 234 as shown in FIGS. 17A and 17B, the paper 236 tends to advance linearly when its trailing edge is about to leave the upper guide plate 230A (FIG. 17A) because it is still bent. However, as soon as the paper 236 leaves the upper guide plate 230A (FIG. 17B**), it springs back causing the deviation, local omission and other troubles associated with an image.

Figure 18:
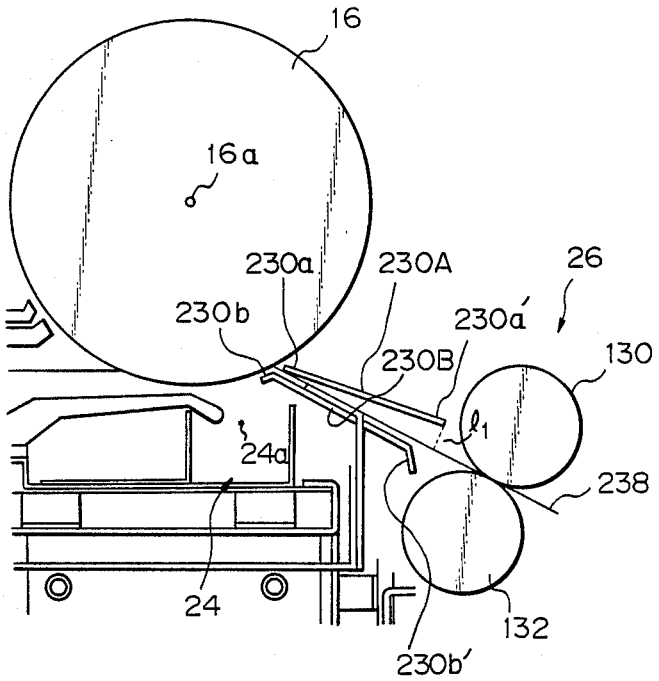

As shown in FIG. 18, the edge **230*b'* of the upper guide plate 230A adjacent to the register roller unit 26 is located at a distance of l from a line 238 tangential to the rollers 130 and 132. Assuming that the rollers 130 and 132 has a diameter of about 20 millimeters each, for example, the distance l is selected to be about 3 millimeters so as to prevent the paper 236 from slipping into between the upper and lower guide rollers 230A and 230B and the rollers 130 and 132. The upper and lower guide plates 230A and 230B are located at opposite sides of the tangential line 238 so that they may not overlap each other. The distance between the guide plates 230A and 230B is sequentially increased from the edges 230*a* and 230*b* toward the edges 230*a*' and 230*b*' to allow the paper 236 to advance from the register roller unit 26 toward the photoconductive element 16** smoothly.

Such a prior art guide arrangement is impractical, however, considering the current trend toward miniaturization of the photoconductive element 16 and other image forming units. Specifically, it is difficult to maintain the above-discussed dimensions and relative positions when it comes to miniature image forming units, i.e., the paper 236 has to be directed toward the photoconductive element 16 at an acute angel. This prevents the paper 236 from making close contact with the element 16 and increases the deflection of the paper 236. Hence, at the instant when the trailing edge of the paper 236 has moved clear of the register roller unit 26, the paper 236 tends to restore its original position with the result that its trailing edge oscillates until it abuts against and is regulated by the upper guide plate 230A. As a result, that part of the paper 236 which has reached the transfer region is prevented from making close contact with the photoconductive element 16, resulting in a defective reproduction due to deviation.

Figure 19:
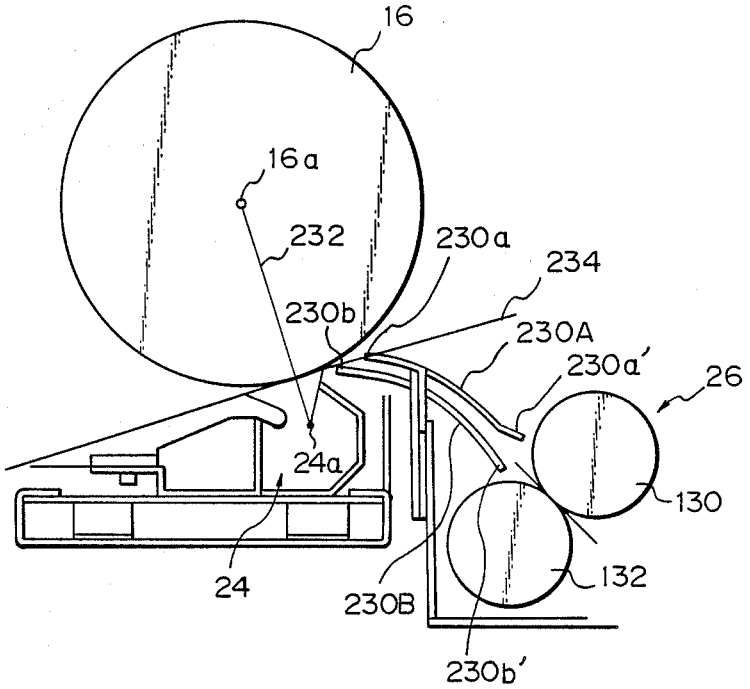
FIGS. 19 and 20 each shows a guide arrangement in accordance with the present invention.
Figure 20:
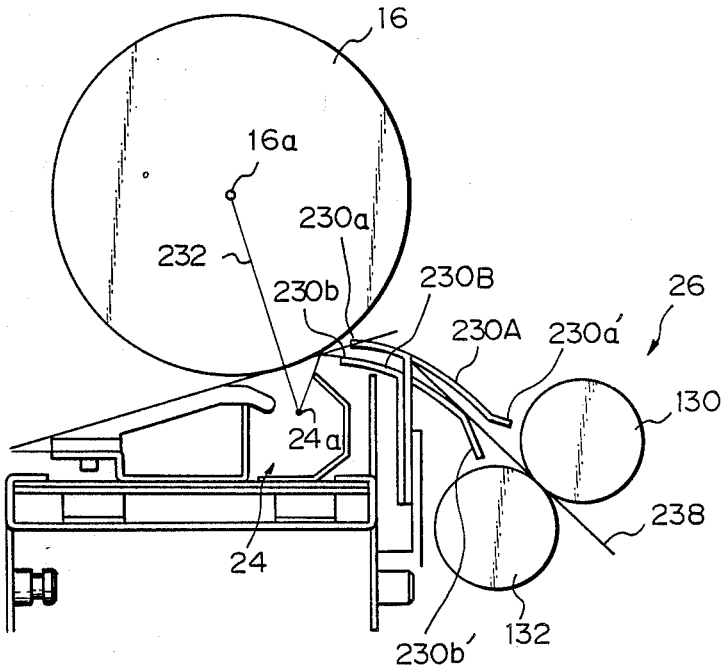

A specific construction of a guide arrangement in accordance with the present invention will be described with reference to FIGS. 19 and 20. In the figures, the same or similar structural elements as those shown in FIGS. 16A, 16B, 17A, 17B and 18 are designated by like reference numerals.

As previously discussed, the deviation, local omission and others of an image on the paper sheet 236 are ascribable to incomplete contact of the paper 236, particularly its trailing edge, with the photoconductive element 16. While transfer current may be increased to intensity the electric field for image transfer and thereby to promote close contact of the paper 236 with the photoconductive element 16, such an approach is not satisfactory for a paper sheet whose trailing edge oscillates unstably. Hence, accurate transfer of an image to the trailing edge of the paper sheet 236 is unachievable unless the sheet feed itself is made smooth enough to regulate the movement of the paper sheet 236. In the illustrative arrangement of the present invention, to free the paper sheet 236 from unnecessary deflections and loads, the lower guide plate 230B is positioned such that its edge **230*b* lies on the tangential line 234 which intersects the line 232 which extends through the center 16*a* of the photoconductive element 16 and the charger wire of the transfer charger unit 24, or such that the distance $L_1$ (not shown) between the edge 230*b* and the tangential line 234 is slightly less than about 0.5 millimeters. When the distance $L_1$ of the lower guide plate 230B was changed by each 0.5 millimeters, images were deviated or omitted as shown in Table 1 below. In Table 1, circles and crosses are representative of "not occurred" and "occurred", respectively, and the plus signs associated with the distance is indicative of a downward direction from the tangential line 234**.

TABLE 1

| DISTANCE $L_1$ (mm) | −0.5 | O | +0.5 | +1.0 | +1.5 |
|---|---|---|---|---|---|
| DEVIATION & OMISSION | X | O | O | Δ | X |

It will be seen that the deviation or omission of an image does not occur when the edge **230*b* of the lower guide plate 230B lies on the tangential line 234 (distance $L_1$ being zero) or slightly below (+0.5 millimeter) the line 234**.

Concerning the upper guide plate 230A, no deviation or omission of an image was observed when the distance $L_2$, not shown, is defined slightly above the tangential line 234 as shown in Table 2 below. In Table 2, the minus sign is indicative of the distance above the tangential line $L_2$.

TABLE 2

| DISTANCE $L_2$ (mm) | −0.5 | O | +0.5 | +1.0 |
|---|---|---|---|---|
| DEVIATION & OMISSION | O | O | Δ~X | X |

It is to be noted that in Tables 1 and 2 triangles are representative of a condition intermediate between the circled and crossed conditions, i.e., an image somewhat poorer than a normal image.

Another cause of incomplete contact of the paper sheet 236 with the photoconductive element 16 is the acute angle at which the paper sheet 236 approaches the element 16 and which is ascribable to the miniaturization of the photoconductive element 16, as stated earlier. The paper sheet 236 moved clear of the rollers 130 and 132 of the register roller unit 26 springs back toward the upper guide plate 230A, and the trailing edge of the paper sheet 236 noticeably oscillates toward the upper guide plate 230A. Such oscillation is imparted to that part of the paper sheet 236 which has reached the transfer region, resulting in the deviation and omission of an image. The illustrative arrangement in accordance with the present invention eliminates the above occurrence by reducing the force with which the paper sheet 236 tends to regain its original position after being bent, i.e., reaction force and by reducing the distance over which the trailing edge of the paper sheet 236 left the rollers 130 and 132 springs back into contact with the upper guide plate 230A. Specifically, as shown in the figures, the lower edge **230*a*' of the upper guide plate 230A adjacent to the register roller unit 26 is bent away from the line 238 which is tangential to the rollers 130 and 132 such that the distance $L_3$ (not shown) between the edge 230*a*' and the tangential line 238** is less than 2 millimeters, for example. Experiments showed that no deviation occurs when the distance $L_3$ is less than 1 to 2 millimeters and deviation is apt to occur and does occur when the distance $L_3$ is greater than 3 millimeters, as respectively represented by circles, triangles and crosses in Table 3 shown below.

TABLE 3

| DISTANCE $L_3$ (mm) | 1.0 | 2.0 | 3.0 | 4.0 |
|---|---|---|---|---|
| DEVIATION | O | O | Δ~X | X |

In summary, it will be seen that in accordance with the present invention a photoconductive element, transfer charger unit and a register roller unit are accommodated in a single image forming case and movable integrally with the case when the latter is mounted and dismounted while being held in a constant relative position, promoting accurate positioning of the photoconductive element, transfer charger unit and register roller unit. Since the case is coupled wiht a printer body by positioning pins and positioning holes, such image forming units can be held in an accurate position relative to the other image forming units also. The register roller unit is removably mounted on the printer body so that easy mounting of transport rollers on the printer body is promoted. Various parts of the register roller unit can be replaced outside of the printer body, realizing easy maintenance. Toner which may drop from a developing unit is received by the casing of the transfer charger unit and, therefore, prevented from contaminating the interior of the printer body and from dropping when the case is drawn out of the printer body.

Transfer charger rails of the transfer charger unit which is mounted on the image forming case are surely grounded via a receptacle, bracket and a bearing plate mechanism which is connected to a ground wire which is in turn attached to the frame of an apparatus body. Even when the transfer charger rails are moved into and out of the apparatus body in the event of mounting and dismounting the case, the rails are connected to ground when the case is loaded in the apparatus body.

The upper edge of a lower guide plate is positioned on or slightly above or below a line which is tangential to the photoconductive element and intersects a line which extends through the center of the photoconductive drum and a charge wire of the transfer charger unit. This frees a paper sheet from unnecessary deflections and loads and allows it to make close contact with the photoconductive element smoothly, whereby an image is successfully transferred to the paper sheet without any deviation or omission, especially at the trailing edge of the paper sheet.

Furthermore, an upper and a lower guide plate are located on opposite sides of a line which is tangential to the rollers of the register roller unit. The lower edge of the upper guide plate is bent away from that tangential line to allow the distance measured from the tangential line to be reduced. Consequently, the reaction force of the paper sheet moved clear of the rollers is reduced to eliminate deviation of an image.

Various modifications will become possible for those skilled in the art after receiving the teachings of the present disclosure without departing from the scope thereof.

What is claimed is:

1. An electrophotographic image forming apparatus including a developing unit for developing a latent image which is provided on a photoconductive element into a visible image, a transfer charger unit for transferring the visible image onto a paper sheet which is fed from a register roller unit, and a cleaning unit for cleaning said photoconductive element, said apparatus comprising:

image forming unit holding means removably mounted on a body of said apparatus and loaded with said photoconductive element, said developing unit and said cleaning unit which are replaceable individually integrally with said unit holding means;

transfer charger holding means detachably mounted on said image forming unit holding means and loaded with said transfer charger unit replaceably;

register roller unit holding means removably mounted on said image forming unit holding means and loaded with said register roller unit replaceably;

transfer charger unit positioning means for positioning said transfer charger unit holding means relative to said body of said apparatus and said image forming unit holding means; and register roller unit positioning means for positioning said register unit holding means relative to said body of said apparatus and said image forming unit holding means.

2. An apparatus as claimed in claim 1, wherein said image forming unit comprises an image forming unit casing having at least a front wall, a rear wall, and a bottom wall.

3. An apparatus as claimed in claim 2, wherein said image forming unit holding means further comprises guide members engaged with and slidably guided by support guide rails which are provided on said body of said apparatus for supporting said image forming unit holding means and guiding said image forming unit holding means when said image forming unit holding means is drawn into and out of said body of said apparatus.

4. An apparatus as claimed in claim 3, further comprising image forming unit holding means positioning means for positioning said image forming unit holding means relative to said body of said apparatus.

5. An apparatus as claimed in claim 4, wherein said image forming unit holding means positioning means comprises a plurality of positioning pins studded on said body of said apparatus, and a plurality of positioning holes formed through said front wall and said rear wall of said image forming unit holding means in alignment with said pins.

6. An apparatus as claimed in claim 2, wherein said transfer charger unit holding means comprises a transfer charger casing comprising opposite side portions each being provided with a rail, a front end portion and a rear end portion, and a lock lever rotatably mounted on said front end portion of said transfer charger casing.

7. An apparatus as claimed in claim 6, further comprising transfer charger unit holding means mounting and dismounting means for rotatably mounting said transfer charger holding means on said image forming unit holding means.

8. An apparatus as claimed in claim 7, wherein said transfer charger unit holding means mounting and dismounting means comprises a pair of lugs provided on the underside of said bottom wall of said image forming unit holding means and each being formed with a rib hole, and a pair of pins studded on said rear end portion of said transfer charger casing and individually rotatably received in said rib holes of said lugs.

9. An apparatus as claimed in claim 8, wherein said transfer charger unit positioning means comprises a pair of pins provided on said front wall of said image forming unit holding means, and a pair hook portions formed in said lock lever and individually engaged with said pins.

10. An apparatus as claimed in claim 2, wherein said register roller unit holding means comprises a roller unit frame comprising a front wall and a rear wall which support a register roller shaft.

11. An apparatus as claimed in claim 10, wherein said register roller unit positioning means comprises a front rib mounted on said front wall of said image forming unit holding means and provided with a pair of pins, a rear rib mounted on said rear wall and provided with a pair of holes, a pair of holes formed through said front wall of said register roller holding means and individually mated with said pins of said front rib, and a pair of pins studded on said rear wall and individually mated with said holes of said rear wall.

12. An apparatus as claimed in claim 6, further comprising grounding means for grounding said transfer charger casing of said transfer charger unit holding means.

13. An apparatus as claimed in claim 12, wherein said grounding means comprises a receptacle, a bracket provided integrally with said receptacle, a bearing plate mounted on said body of said apparatus and rotatably supporting said bracket, and a ground wire electrically connected at one end to said bearing plate and at the other end to said body of said apparatus, whereby said transfer charger casing is grounded via said rails of said transfer charger casing and said bearing plate which are brought into contact when said transfer charger unit holding means is mounted on said body of said apparatus.

14. An apparatus as claimed in claim 1, further comprising guide means interposed between said photoconductive element and transfer charger unit and said register roller unit for guiding the paper sheet.

15. An apparatus as claimed in claim 14, wherein said guide means comprises an upper and a lower guide plate, said photoconductive element comprising a drum, said transfer charger unit comprising a charge wire, said register roller unit comprising a pair of register rollers.

16. An apparatus as claimed in claim 15, wherein an edge of said upper guide plate adjacent to said photoconductive element is positioned on a tangential line which is tangential to said photoconductive element and intersects a line which extends through the center of said photoconductive element and said charge wire.

17. An apparatus as claimed in claim 16, wherein an edge of said lower guide plate adjacent to said photoconductive element is positioned on said tangential line.

18. An apparatus as claimed in claim 16, wherein an edge of said lower guide plate adjacent to said photoconductive element is positioned below said tangential line.

19. An apparatus as claimed in claim 15, wherein an edge of said upper guide plate adjacent to said photoconductive element is positioned above a tangential line which is tangential to said photoconductive element and intersects a line which extends through the center of said photoconductive element and said charge wire.

20. An apparatus as claimed in claim 19, wherein an edge of said lower guide plate adjacent to said photoconductive element is positioned on said tangential line.

21. An apparatus as claimed in claim 18, wherein an edge of said lower guide plate adjacent to said photoconductive element is positioned below said tangential line.

22. An apparatus as claimed in claim 15, wherein an edge of said upper guide plate adjacent to said register rollers is bent away from a tangential line which is tangential to said register rollers and positioned such that a distance between said edge and said tangential line is less than a predetermined value.

23. In an image forming apparatus including a photoconductive drum, a transfer charger unit having a charge wire, a register roller unit having a pair of register rollers, and a guide device having an upper guide plate and a curved lower guide plate for guiding toward said photoconductive drum and said transfer charger unit a paper sheet which is transported from said register roller unit, the improvement wherein an edge of said upper guide plate adjacent to said photoconductive element is positioned on a tangential line which is tangential to said photoconductive element and intersects a line which extends through the center of said photoconductive element and said charge wire.

24. An apparatus as claimed in claim 23, wherein an edge of said lower guide plate adjacent to said photoconductive element is positioned on said tangential line.

25. An apparatus as claimed in claim 23, wherein an edge of said lower guide plate adjacent to said photoconductive element is positioned below said tangential line.

26. In an image forming apparatus including a photoconductive drum, a transfer charger unit having a charger wire, a register roller unit having a pair of register rollers, and a guide device having an upper guide plate and a lower curved guide plate for guiding toward said photoconductive drum and said transfer charger unit a paper sheet which is transported from said register roller unit, the improvement wherein an edge of said upper guide plate adjacent to said photoconductive element is positioned above a tangential line which is tangential to said photoconductive element and intersects a line which extends through the center of said photoconductive element and said charge wire.

27. An apparatus in accordance with claim 26, wherein wherein an edge of said lower guide plate adjacent to said photoconductive element is positioned on said tangential line.

28. An apparatus as claimed in claim 26, wherein an edge of said lower guide plate adjacent to said photoconductive element is positioned below said tangential line.

29. In an image forming apparatus including a photoconductive drum, a transfer charger unit having a charger wire, a register roller unit having a pair of register rollers, and a guide device having an upper and a lower guide plate for guiding toward said photoconductive drum and said transfer charger unit a paper sheet which is transported from said register roller unit, the improvement wherein an edge of said upper guide plate adjacent to said register rollers is bent away from a tangential line which is tangential to said register rollers and positioned such that a distance between said edge and said tangential line is less than a predetermined value.

30. In an image forming apparatus including a photoconductive drum, a transfer charger unit having a charge wire, a register roller unit having a pair of register rollers, and a guide device having an upper and a lower guide plate for guiding toward said photoconductive drum and said transfer charger unit a paper sheet which is transported from said register roller unit, the improvement wherein an edge of said upper guide plate adjacent to said photoconductive element is positioned on a tangential line which is tangential to said photoconductive element and intersects a line which extends through the center of said photoconductive element and said charge wire and wherein an edge of said lower guide plate adjacent to said photoconductive element is positioned on said tangential line.

31. In an image forming apparatus including a photoconductive drum, a transfer charger unit having a charge wire, a register roller unit having a pair of register rollers, and a guide device having an upper and a lower guide plate for guiding toward said photoconductive drum and said transfer charger unit a paper sheet which is transported from said register roller unit, the improvement wherein an edge of said upper guide plate adjacent to said photoconductive element is positioned on a tangential line which is tangential to said photoconductive element and intersects a line which extends through the center of said photoconductive element and said charge wire and wherein an edge of said lower guide plate adjacent to said photoconductive element is positioned on said tangential line.

* * * * *